United States Patent [19]

Winzelberg

[11] 4,285,505

[45] Aug. 25, 1981

[54] APPARATUS FOR USE IN FORMING A FINISH ON A JEWELRY BAND

[76] Inventor: Abraham Winzelberg, 3620 Bowne St., Flushing, N.Y. 11354

[21] Appl. No.: 106,937

[22] Filed: Dec. 26, 1979

[51] Int. Cl.[3] ..... B25B 5/14

[52] U.S. Cl. ..... 269/50

[58] Field of Search ..... 269/99–100, 269/82–84, 47, 50, 51; 29/160.6

[56] References Cited

U.S. PATENT DOCUMENTS

| | | | |
|---|---|---|---|
| 2,675,609 | 4/1954 | Miller | 269/84 X |
| 2,969,231 | 1/1961 | Mills | 269/84 X |
| 4,103,882 | 8/1978 | Winzelberg | 269/51 |

*Primary Examiner*—Robert C. Watson

*Attorney, Agent, or Firm*—Peter L. Berger

[57] ABSTRACT

An apparatus for use in forming a finish on a jewelry band includes a base including a base plate mountable to a fixed support and having a threaded bore oriented normally to the surfaces of the plate, a chassis including a chassis plate locatable adjacent the base plate and having a bore therethrough, the chassis also including a pair of supports mounted to the chassis plate, threaded screw means for securing the chassis plate to the base plate, and a mandrel having a frustro-conical shape for allowing the mounting of jewelry bands thereon, the supports having apertures therein for mounting the mandrel therein, wherein the chassis plate is rotatable with respect to a work surface upon which the apparatus is placed.

5 Claims, 4 Drawing Figures

APPARATUS FOR USE IN FORMING A FINISH ON A JEWELRY BAND

BACKGROUND OF THE INVENTION

1. Field of the Invention

This invention relates generally to jewelry making and, in particular, to apparatus for holding pieces of jewelry during fabrication.

2. Statement of the Prior Art

Jewelry bands bearing a variety of surface designs and finishes enjoy a wide popularity. Often these finishes are painstakingly applied by hand in the same manner as a sculptor creates a work of art. One specific example of this is surface finishes which are formed by a process of repeatedly stamping a band surface with either the same or different geometric shapes to produce an infinite variety of symmetrical and asymmetrical designs. Normally, a stamping die is held against the band surface and struck from behind. In order to allow control of the design which is created, it is necessary that the craftsman be able to accurately determine the amount of force applied between the stamping die and the surface and the angle at which the die is applied to the surface. For these purposes it is necessary that the jewelry band be securely mounted by some form of apparatus and that the orientation of the band in the apparatus be easily changed to allow the craftsman to work in the most convenient position for controlling the angle of application and the amount of force applied.

Various stationary vice-type apparatuses exist for mounting jewelry bands while their surface finishes are being formed. Unfortunately, it is often difficult or inconvenient while using such apparatuses to reposition the jewelry band before every stamping operation. One apparatus which does allow relatively easy repositioning is described in my prior U.S. Pat. No. 4,103,882. The apparatus described therein includes a frustro-conically shaped mandrel which is force fitted in either one or both of a pair of apertures each of which is located in a separate support. The supports, in turn, are part of a complicated assembly for mounting the support in an infinite variety of spatial orientations. The rotational orientation of the mandrel may also be changed by removing the force fit of the mandrel, rotating the mandrel and then re-establishing its force fit.

Further, the prior device includes a chassis 24, from which depend stabilizing arms 28, which themselves set on blocks 36 which rest on the support surface. Thus, there are no rigid connections between chassis 24 and the support surface, and it has been found the positions of the mandrel becomes jostled under repeated hammering of the stamping die on the ring mounted on the mandrel. Therefore, the prior art device became inaccurate in use.

An object of this invention is to provide an apparatus for rigidly supporting a mandrel, even under repeated striking of a band located thereon.

Still another object is to provide such an apparatus which permits easy rotation of the apparatus in a horizontal plane, yet provides rigid secure support once the spatial orientation of the apparatus is fixed.

Still another object of this invention is to provide such apparatus which is easy to use, and efficient in operation.

Other objects, advantages and features of this invention will become more apparent from the following description.

SUMMARY OF THE INVENTION

In order to provide an apparatus for use in forming finishes on jewelry bands, which apparatus provides a similar degree of flexibility in the spatial circulation of the mounted band as previously developed devices, and which apparatus is much simpler than such previously developed devices and thus much less expensive to produce, the present invention has been developed. The present invention comprises a base including an elongated flat base plate having upper and lower surfaces, the base plate also having a threaded bore centrally located thereon and oriented normal to the upper and lower surfaces, the base plate also having means for firmly securing it to a fixed structure for support. A chassis is provided including a second elongated smaller flat chassis plate located on the base plate. The chassis plate also has a centrally located bore in alignment with that of the base plate. The chassis also includes a pair of end supports with each support mounted near opposite ends of the chassis plate with each of the supports being vertical and being attached to the chassis plate upper surface. Threaded screw means engageable with the threaded base plate bore is provided which is adapted to pass through the chassis plate bore for exerting downward pressure on the chassis plate. An elongated mandrel having a frustro-conical shaped portion for allowing the mounting of a jewelry band thereon is provided and each of the supports has apertures adapted to receive the mandrel on either side of the frustro-conically shaped portion for allowing mounting of the mandrel on the supports.

To position the mandrel, the threaded screw means is loosed permitting the mandrel plate to be rotated to any desired position as it moves over the base plate.

BRIEF DESCRIPTION OF THE DRAWINGS

The present invention is illustratively described below in reference to the appended drawings, in which.

DETAILED DESCRIPTION OF THE DRAWINGS

Figure 1:
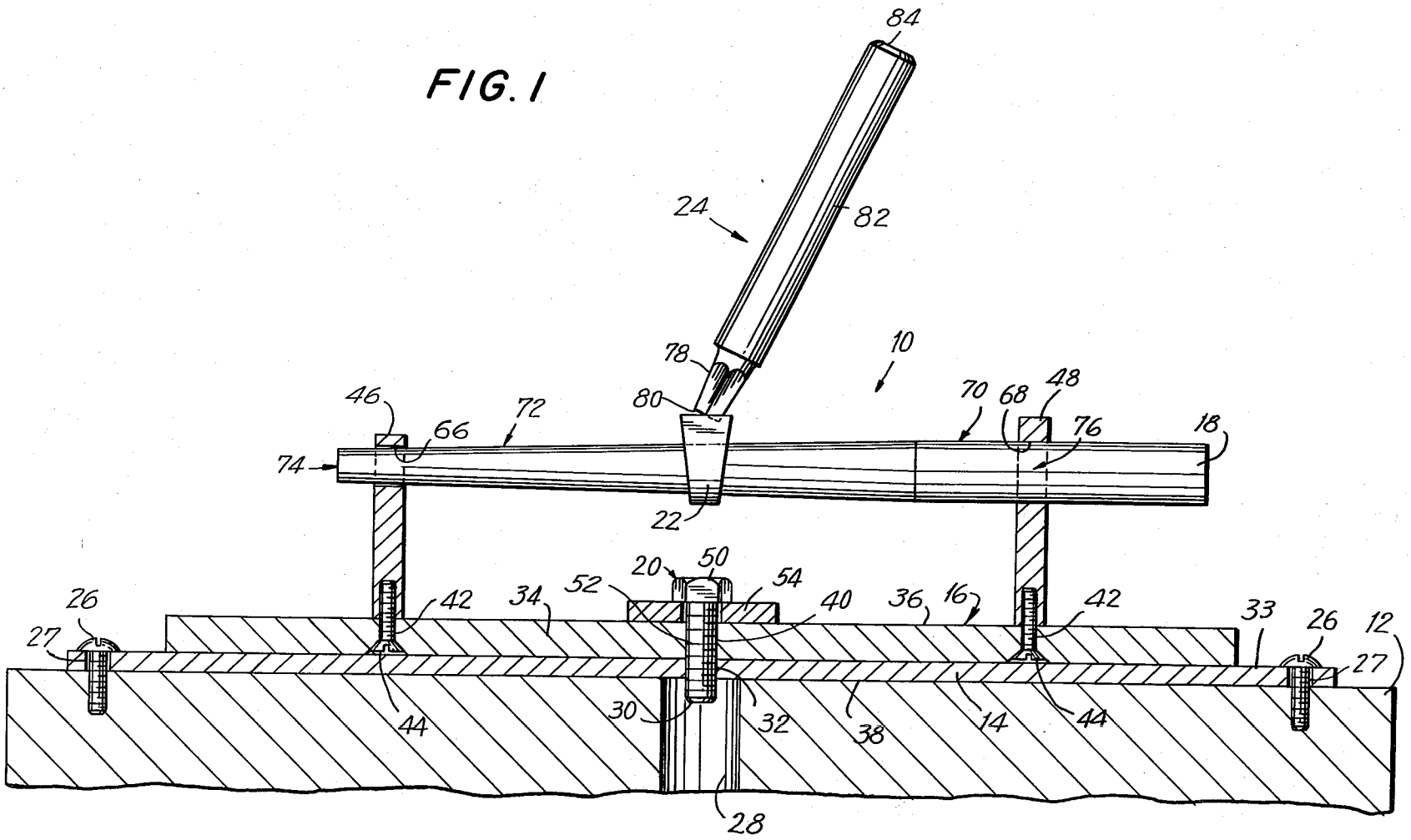
FIG. 1 is a partially sectioned view of an apparatus constructed according to the present invention.
Figure 2:
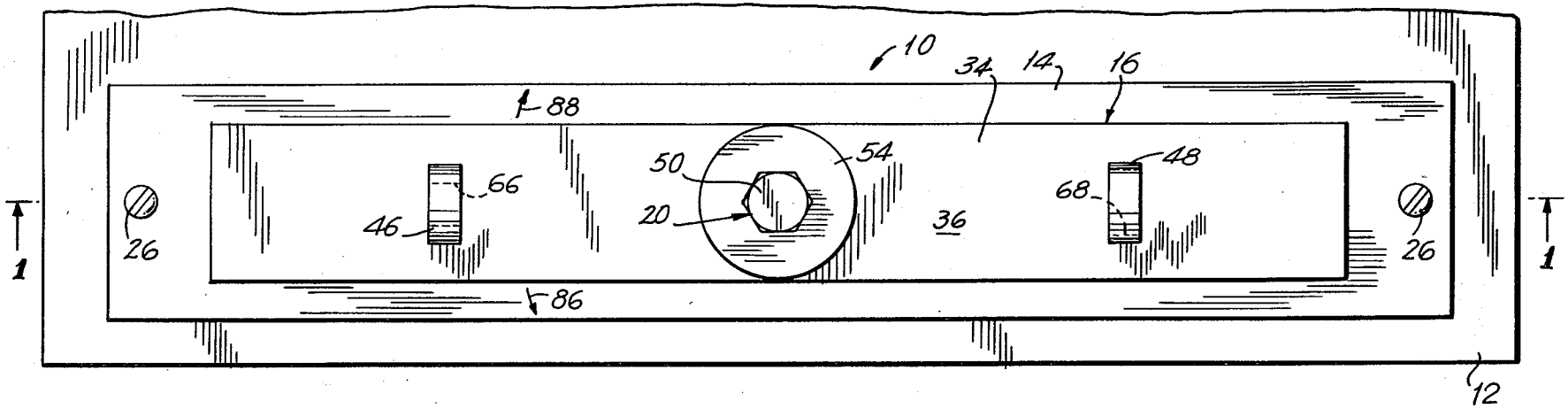
FIG. 2 is a top view of part of the apparatus of FIG. 1, the view lines 1—1 thereof showing the sectioning taken for FIG. 1 along the lower half of the apparatus.

In reference to FIGS. 1 and 2, an apparatus 10 is shown for use in making jewelry. The apparatus 10 is shown affixed to a work surface 12 and generally includes a base plate 14, a chassis 16 for mounting a mandrel 18 and a screw means 20 for mounting the chassis 16 to the base plate 14. FIG. 1 also shows work piece 22 and a surface finishing tool 24. The mandrel 18, work piece 22 and tool 24 are not shown in FIG. 2 in order to show the remainder of the apparatus 10 in greater detail.

More specifically, the apparatus 10 includes an elongated, flat rectangular base plate 14 which is affixed to any suitable support structure such as a work surface 12. The purpose for this is to hold the apparatus stationary during jewelry finishing operations. The base plate 14 is affixed to the work surface 12 by means of two bolts 26 passing through respective holes (27) located in the base plate 14. Any suitable means for firmly affixing the base plate 14 to the work surface 12 may be used. The work surface 12 also includes a recess or cavity 28 into which the end 30 of the scren means 20 may extend.

The base plate 14 includes a centrally located threaded bore 32 adapted to threadedly engage the screw means 20. The threaded bore 32 is oriented normally to both the upper and lower surfaces of the base plate 14. The recess 28 is in general register with the threaded bore 32 when the base plate 14 is properly affixed to the work surface 12.

The chassis 16 is affixed to the base plate 14 by the screw means 20. The chassis 16 includes an elongated flat chassis plate 34 having an upper surface 36 and a lower surface 38. The chassis plate is somewhat smaller than the base plate and sits within the contour of the base plate. Centrally located on the chassis plate 34 is a bore 40 through which the screw means 20 passes. Also located on the chassis plate 34 are four holes or bores 42 (two shown). Four Allen-head set- screws 44 (two shown) are located in the holes 42 for securing the supports 46 and 48 to the chassis plate 34. The supports 46 and 48 are further discussed below.

The screw means 20 secures the chassis 16 to the base plate 14 by exerting downward pressure on the chassis plate 34 to press the lower surface 38 thereof against the upper surface 33 of the base plate 14. The screw means 20 may comprise any suitable device including a simple nut having a head 50 and a threaded body 52. A simple washer 54 may be located between the head 50 and the upper surface 36 of the chassis plate 34 for transmitting downward pressure on the plate 34 when the screw means 20 is tightened into the threaded bore 32.

Figure 4:
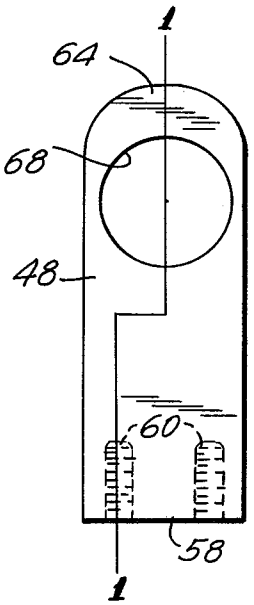
FIG. 4 is a side view of another portion of the apparatus of FIG. 1, the view lines 1—1 thereof showing the sectioning taken for FIG. 1 in that portion of the apparatus as viewed from the right side.
Figure 3:
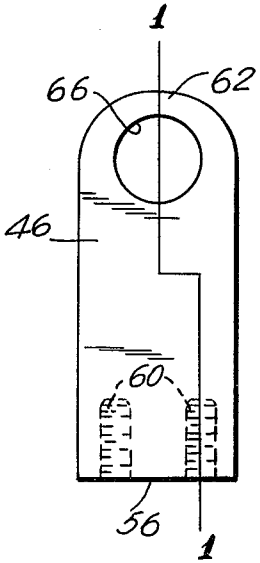
FIG. 3 is a side view of a portion of the apparatus of FIG. 1, the view lines 1—1 thereof showing the sectioning taken for FIG. 1 in that portion of the apparatus, as viewed from the left side.

The supports 46 and 48 are each mounted at opposite ends of the chassis plate 34 and are vertically oriented. In the apparatus 10, the supports 46 and 48 are mounted generally perpendicular to the upper surface 36, and as shown in FIGS. 3 and 4, the supports 46 and 48 include two slightly elongated plates. One end 56 and 58 of each of the plates 46 and 48 is prepared for attachment to the chassis plate 34 by the formation of two threaded bores 60 therein. The threads of the bores 60 are adapted to engage the threads of the screws 44. The other ends 62 and 64 of the supports 46 and 48 are adapted to mount the mandrel 18 by having bores 66 and 68 formed therein and by having rounded corners.

Referring back to FIGS. 1 and 2, the mandrel 18 includes a portion thereof, indicated between points 70 and 72, which has a frusto-conical shape on which a jewelry band 22 may be force fitted. The frusto-conical shape allows the mandrel 18 to accommodate bands of different sizes and allows for the force fitting of the bands thereto. The gradually reducing diameter portion of the mandrel 18 may even extend to the end 74 of the mandrel 18 for the purpose of allowing the force fitting of the mandrel 18 in the bore 66 of the support 46. The portion 76 of the mandrel 18 which aligns with the support 48 when the mandrel 18 is force fitted in the bore 66 may be constant and of such a diameter to maintain a closely abutting relationship with the bore 68. This provides for firm support of the mandrel 18 by the chassis 16.

The stamping tool 24 is located in a position in which it may be used for finishing the surface of the jewelry band 22. The stamping tool 24 has a lower die portion 78 with a die pattern formed on the end 80 thereof. The stamping tool 24 also includes a handle portion 82 and an upper striking end 84. Further description of the stamping tool 24 may be had by reference to the aforementioned U.S. Pat. No. 4,103,882.

The apparatus 10 may be made of any suitable material, such as steel.

In operation, the present invention provides a simple apparatus for convenient use in forming a finish on jewelry bands and for performing other fabrication and repair operations. The apparatus is fixedly attached to any suitable work surface 12. The end 74 of the mandrel 18 is inserted through the hole 68 in the support 48. The jewelry band 22 is placed on the mandrel 18 and moved in the direction of increasingly conical diameter of the mandrel 18 until it is force fitted thereon. The rotational position of the mandrel 18 is selected to provide the proper positioning (preferably upward) of the portion of the jewelry band 22 to be worked on. The end 74 of the mandrel is inserted through the hole 66 and then force fitted therein in the desired rotational position. The desired rotational position of the chassis 16 is then selected by movement of the chassis in the direction indicated by either of the arrows 86 or 88 after the screw 20 has been loosed to permit such rotation. Torque is then applied to the head 50 of the screw means 20 to exert downward pressure on the chassis plate 34 and press the lower surface 38 thereof against the upper surface 33 of the base plate 14. The stamping tool 24 may then be placed against the jewelry band 22 as shown and struck on the head 84 for applying the die pattern located on the end 80 to the jewelry surface. The rotational position of the mandrel 18 with respect to the chassis 16 may be easily changed and/or the rotational position of the chassis 16 with respect to the base plate 14 may be easily changed for allowing repositioning of the jewelry band 22. Of course, various of the above steps may also be performed out of sequence or in a sequence other than that given above.

Thus, employed, the present invention provides a simple and inexpensive apparatus for use in securely holding jewelry bands in desired positions during the formation of surface finishes thereon and various other fabricating and repair procedures. Further, the present invention provides such an apparatus which is fixedly connected to the work surface during operation.

Although the invention has been described in terms of an embodiment for illustrative purposes, it will be appreciated by one skilled in the art that numerous additions, substitution and modifications are possible without departing from the scope and spirit of the invention as defined in the accompanying claims.

What is claimed is:

1. Apparatus for holding a ring in place on a mandrel placed on a work surface while the surface of the ring is sculpted by the hammering of a stamping die against the surface of the ring, said apparatus comprising a flat base plate having a threaded aperture therethrough, a chassis comprising a flat chassis plate resting on said base plate, said chassis plate having an aperture which is in registry with the aperture of said base plate, said work surface having a recess adapted to be in registry with said apertures, a pair of opposite vertical supports fixedly attached to said chassis plate with each of said supports having respective apertures therethrough, said apertures of said supports being in horizontal alignment, an elongated mandrel having a frusto-conical shaped portion for allowing the mounting of a jewelry band thereon, said mandrel being press fit into said apertures of said supports to allow rigid mounting of the mandrel on the support, and a threaded member for passing through said apertures of said base plate and said chassis plate to be threaded into said threaded aperture of said base plate to firmly secure said chassis to said work surface when said threaded member is tightened in said threaded aperture of said base plate, said threaded member being loosened to permit horizontal repositioning of said chassis with respect to said work surface, the vertical position of said mandrel being fixed with respect to said work surface in accordance with the location of the apertures in said opposite vertical supports.

2. The apparatus of claim 1, wherein said frusto-conically shaped portion of said mandrel extends to one end of said mandrel in the direction of reducing conical diameter, and further wherein one of said apertures in said chassis supports is adapted to force fit said one end of said mandrel for holding said mandrel securely in said supports.

3. The apparatus of claim 1, wherein said threaded member has a head portion, further comprising a washer located between said head portion and said chassis plate.

4. The apparatus of claim 1, wherein said base plate is fixedly connected in a stationary position to said work surface and said chassis is rotatable with respect to said base plate.

5. The apparatus of claim 4, wherein said apertures in said base plate and said chassis plate are substantially centrally located.

* * * * *